US009121165B2

(12) United States Patent
Guthrie

(10) Patent No.: US 9,121,165 B2
(45) Date of Patent: Sep. 1, 2015

(54) ADJUSTABLE FLUSH VALVE AND ASSEMBLY

(71) Applicant: LAVELLE INDUSTRIES, INC., Burlington, WI (US)

(72) Inventor: Kevin J. Guthrie, Wind Lake, WI (US)

(73) Assignee: Lavelle Industries, Inc., Burlington, WI (US)

( * ) Notice: Subject to any disclaimer, the term of this patent is extended or adjusted under 35 U.S.C. 154(b) by 488 days.

(21) Appl. No.: 13/630,832

(22) Filed: Sep. 28, 2012

(65) Prior Publication Data

US 2013/0081201 A1 Apr. 4, 2013

Related U.S. Application Data

(60) Provisional application No. 61/541,820, filed on Sep. 30, 2011.

(51) Int. Cl.
*E03D 1/35* (2006.01)

(52) U.S. Cl.
CPC ..... *E03D 1/35* (2013.01)

(58) Field of Classification Search
CPC ..... E03D 1/306
USPC ..... 4/378, 392, 393
See application file for complete search history.

(56) References Cited

U.S. PATENT DOCUMENTS

| | | | | |
|---|---|---|---|---|
| 5,903,931 | A * | 5/1999 | Kolb, Sr. | 4/393 |
| 7,636,958 | B2 * | 12/2009 | Nichols-Roy et al. | 4/378 |
| 2005/0172387 | A1 * | 8/2005 | Higgins | 4/354 |

* cited by examiner

*Primary Examiner* — Tuan N Nguyen
(74) *Attorney, Agent, or Firm* — Joseph S. Heino; Patrick M. Bergin

(57) ABSTRACT

A tank to bowl sponge gasket is provided for use with a flush valve used in the drain hole of a toilet tank, the tank sitting above the throat of a toilet bowl. The flush valve comprises a flange above the bottom wall, a lower externally threaded portion that extends through the drain hole and an internally threaded lock nut which complements the lower threaded portion of the flush valve, a tank seal disposed between the flange and the tank wall, and the gasket is disposed between the lower threaded portion of the flush valve, the lock nut and the tank wall and the throat of the toilet bowl. The gasket has a generally L-shaped upper portion with a circumferential outer surface, a circumferential inner surface and a bottom shelf, a lower portion comprising a circumferential inner surface and an inwardly tapered outer surface, and a circumferential trim line.

15 Claims, 5 Drawing Sheets

ADJUSTABLE FLUSH VALVE AND ASSEMBLY

This Application claims the benefit of U.S. Provisional Application No. 61/541,820, filed Sep. 30, 2011.

FIELD OF THE INVENTION

The present invention relates to indoor plumbing, and more particularly, to gravity-operated flush toilets and flush valves for such toilets.

BACKGROUND OF THE INVENTION

A conventional gravity-operated flush toilet has several basic components. The porcelain or china components include a bowl and a water tank mounted on top of a rear portion of the bowl. The bowl and tank are usually separate pieces bolted together to form a so-called two-piece toilet. Modern gravity-operated flush toilets are frequently made as a so-called one-piece toilet in which the bowl and tank are made as one continuous integral piece of china.

The plumbing components of a gravity-operated flush toilet include a fill valve in the tank which is connected to a water supply line, a flush valve surrounding a drain hole in the bottom of the tank that communicates with the bowl, and a flapper valve that normally closes and seals the flush valve. The plumbing components further include a control such as a pushbutton or lever mounted on a wall of the tank that moves a lever whose remote end is connected to the flapper valve for lifting the same.

In the experience of this inventor, a wide variety of two-piece flush valves are used in toilets of current manufacture, each of which is used with toilet tank openings ranging from 3.25 inches to 3.95 inches in diameter. It would, however, be advantageous to provide an original manufacture flush valve and an after-installation flush valve that is constructed as a 3.00 inch diameter flush valve that can be used universally with toilet tank openings within the range of diameters mentioned above. Also in the experience of this inventor, no single flush valve and flush valve assembly currently in the art provides use of a 3.00 inch diameter flush valve for use with such a wide range of toilet tank openings. It would also be advantageous, as part of a universal assembly to provide a gasket that allows this wide range of variability. In the experience of this inventor, such a gasket would need to be of a soft elastomeric material, such as that used in flapper valves of current manufacture, and would be capable of simple adaptation and modification to specific applications while ensuring a good seal between the gasket, the flush valve and the toilet tank opening, as well as with the opening to the bowl which sits directly beneath the toilet tank opening.

SUMMARY OF THE INVENTION

In accordance with the present invention, there is provided a flush valve that can be used with toilet tank openings ranging from 3.25 inches to 3.95 inches in diameter. The flush valve is constructed as a 3.00 inch diameter flush valve that can be used universally with toilet tank openings within the range of diameters mentioned above. As part of a universal assembly includes a unique gasket that allows this wide range of variability. The gasket is made of a soft elastomeric material, such as that used in flapper valves of current manufacture, and allows for simple adaptation and modification to specific applications while ensuring a good seal between the gasket, the flush valve and the toilet tank opening, as well as with the opening to the bowl which sits directly beneath the toilet tank opening.

The foregoing and other features of the device and assembly of the present invention will be apparent from the detailed description that follows.

DETAILED DESCRIPTION

Figure 1:
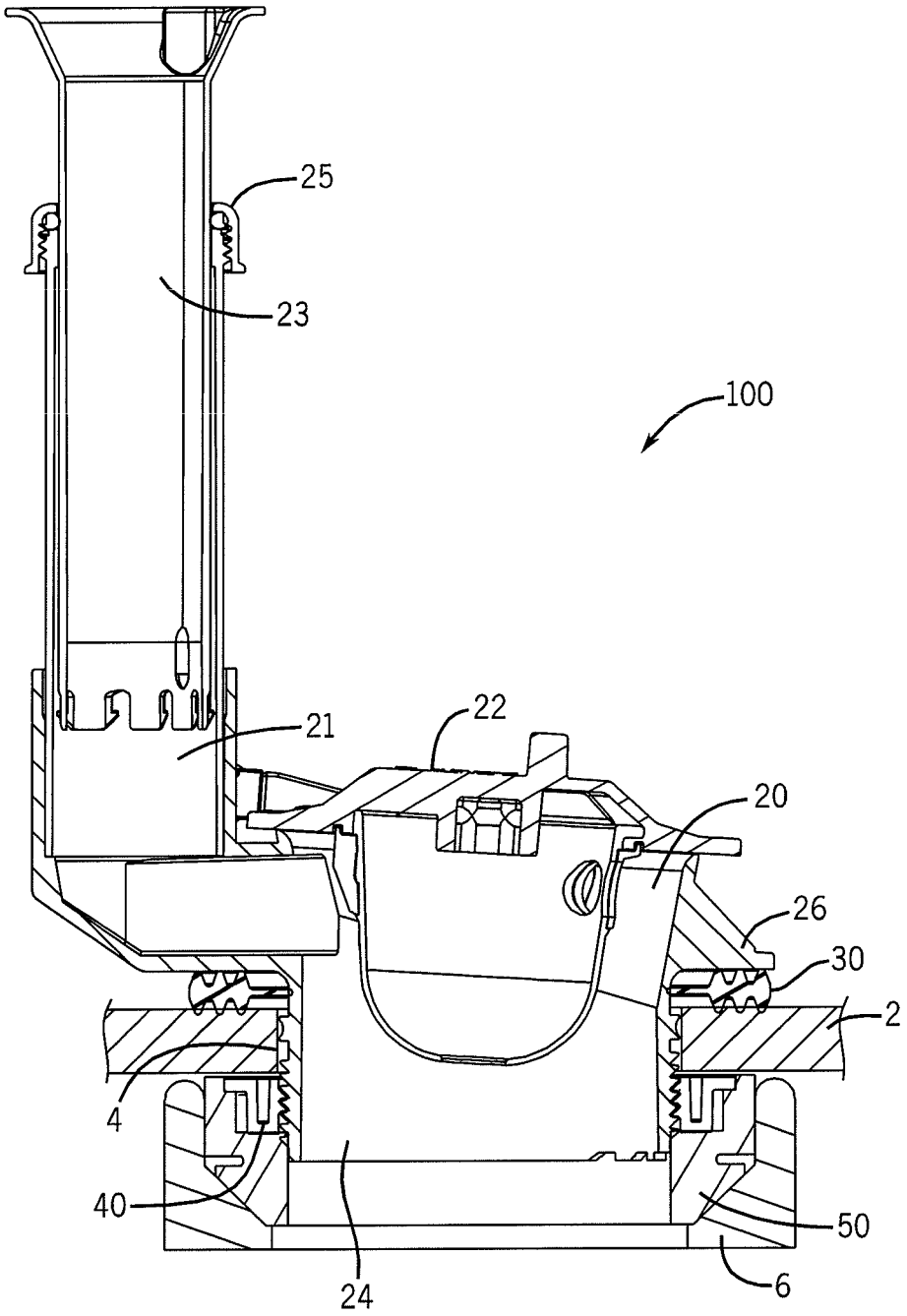
FIG. 1 is a side and cross-sectioned view of one embodiment of the flush valve and assembly that is constructed in accordance with the present invention.

Referring now to the drawings in detail, wherein like-numbered elements refer to like elements throughout, FIG. 1 illustrate a flush valve assembly, generally identified 100, which is constructed in accordance with the present invention. The flush valve assembly 100 comprises a flush valve body, or flush valve, 20 within which is seated a flapper valve 22. The flapper valve 22 is movable between an "open" position which empties the tank and a "closed" position (as shown) which allows the tank to refill. A portion of the bottom wall 2 of the tank is shown in FIG. 1, together with a circular drain hole or tank opening 4. The flush valve 20 further comprises a lower threaded portion 24 which extends through the tank opening 4. A portion of the flush valve 20 also forms a flange 26. When the flush valve 20 is mounted within the opening 4, the flange 26 captures a tank seal 30 between the flange 26 and the upper surface of the tank bottom 2. A threaded locking nut 40 is used to secure the lower threaded portion 24 of the flush valve 20 to the tank. Disposed below the flush valve 20 is a full "tank to bowl" sponge gasket 50 which sits in the throat of the toilet bowl 6. The flush valve 20 also comprises a number of other parts, namely, a lower adjustable tube 21, an upper adjustable tube 23 and a locking nut 25, the upper adjustable tube 23 being movable within the lower adjustable tube 21. The position of the tubes 21, 23 can then be fixed using the locking nut 25.

Figure 5:
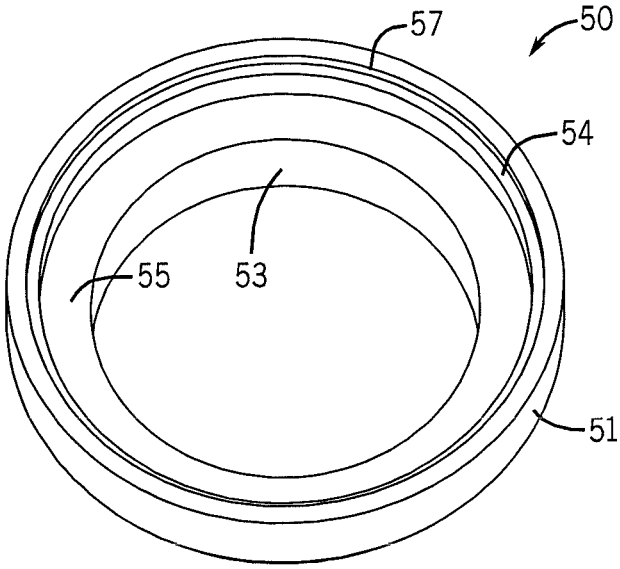
FIG. 5 is a top perspective view of the gasket used in the flush valve and assembly of the present invention.
Figure 6:
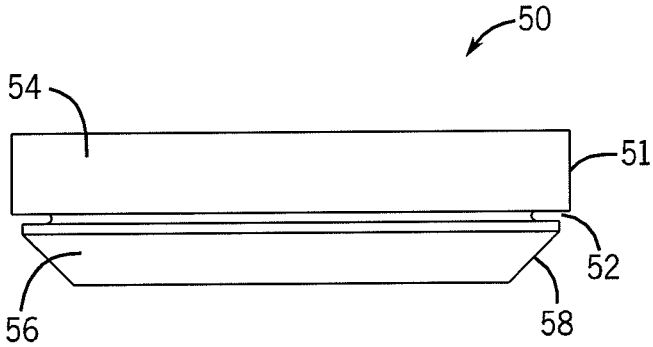
FIG. 6 is a side elevational view of the gasket shown in FIG. 5.
Figure 7:
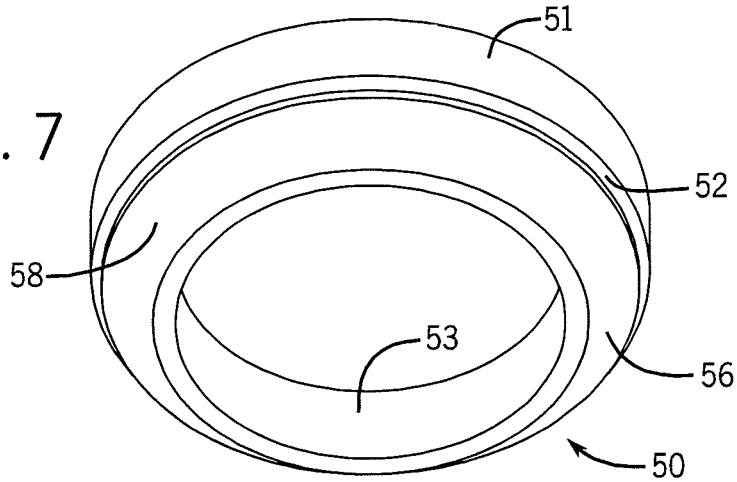
FIG. 7 is a bottom perspective view of the gasket shown in FIGS. 5 and 6.

The "tank to bowl" sponge gasket 50 alluded to above is a most unique and novel structure. Specifically, the circular gasket 50 has a circumferential "cut ring" or "trim line" 52 built into it. See FIGS. 5 through 7. The gasket 50 further comprises an upper portion 54 which is generally L-shaped in cross section with a circumferential outer surface 51, a circumferential inner surface 53 and a bottom shelf 55. A secondary recess 57 is formed at the top of the upper portion 54. The gasket 50 further has a lower portion 56 which comprises the same circumferential inner surface 53 and an inwardly tapered or chamfered outer surface 58. In this configuration, the cut ring 52 allows the gasket 50 to be universal. That is, some toilets require a small gasket and others require larger gaskets. Using a gasket 50 of the present invention with a cut ring 52 allows the ring 50 to be used in a wide range of toilets, as will be apparent during the description of the following alternative embodiments.

Figure 2:
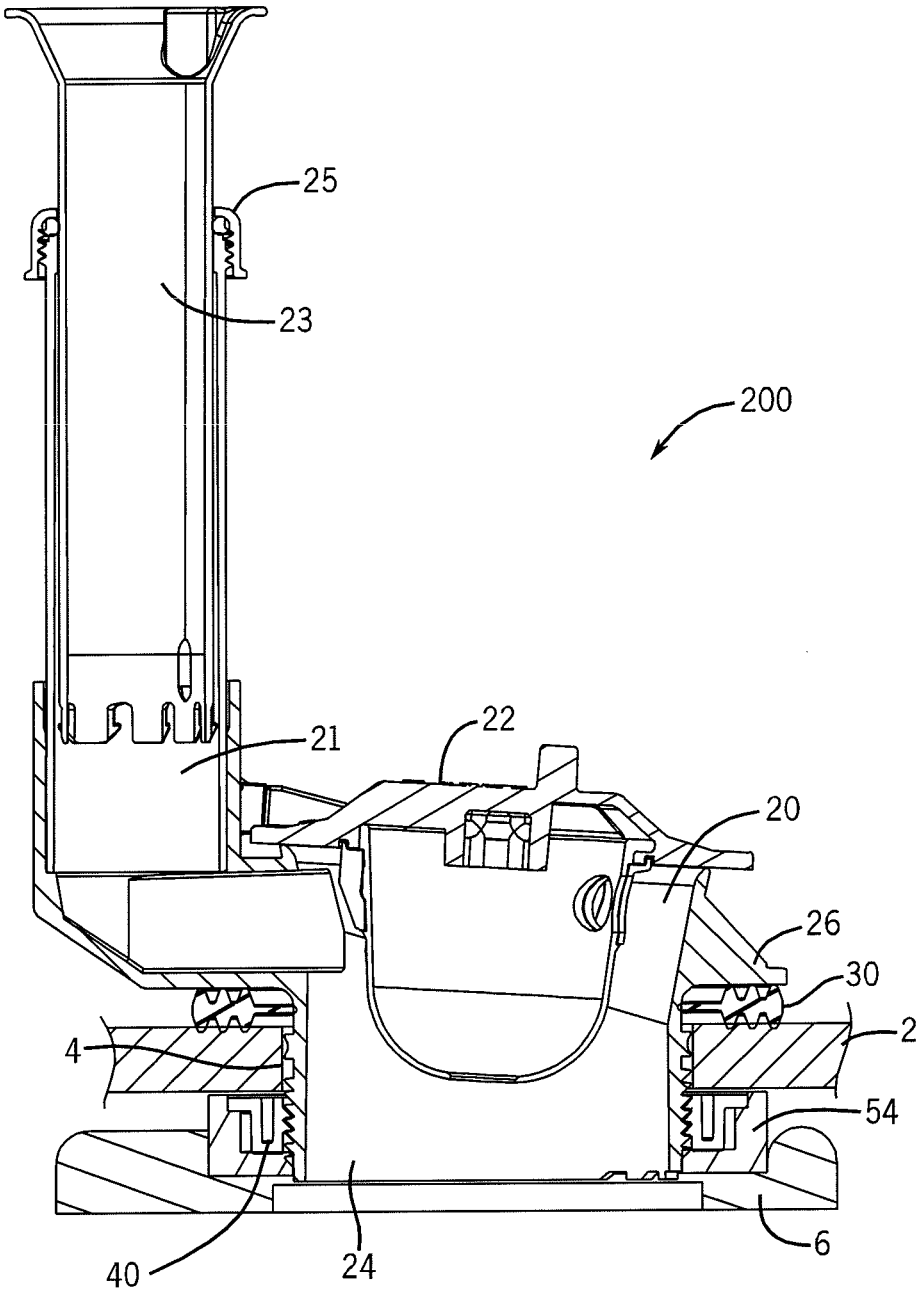
FIG. 2 is a side and cross-sectioned view of a second embodiment of the flush valve and assembly that is constructed in accordance with the present invention.

Referring now to FIG. 2, it illustrates a second flush valve assembly, generally identified 200, which is constructed in accordance with the present invention. The flush valve assembly 200 comprises the flush valve 20 and flapper valve 22 as previously discussed wherein the flapper valve 22 is movable between an "open" position which empties the tank and a "closed" position (as shown) which allows the tank to refill. A portion of the bottom 2 of the tank is shown in FIG. 2, together with the circular tank opening 4. The lower threaded portion 24 of the flush valve 20 extends through the tank opening 4. A portion of the flush valve 20 forms the flange 26 such that, when the flush valve 20 is mounted within the opening 4, the flange 26 captures a tank seal 30 between the flange 26 and the upper surface of the tank bottom 2 as previously described. A threaded locking nut 40 is used to secure the lower threaded portion 24 of the flush valve 20 to the tank. Disposed below the flush valve 20 is the upper portion 54 of the sponge gasket 50, the lower portion 56 of the sponge gasket 50 having been removed below the cut line 52. Thus, it will be appreciated that the upper portion 54 of the sponge gasket 50 sits in the slightly wider throat of the toilet bowl 6. The flush valve 20 also comprises the other components previously described.

Figure 3:
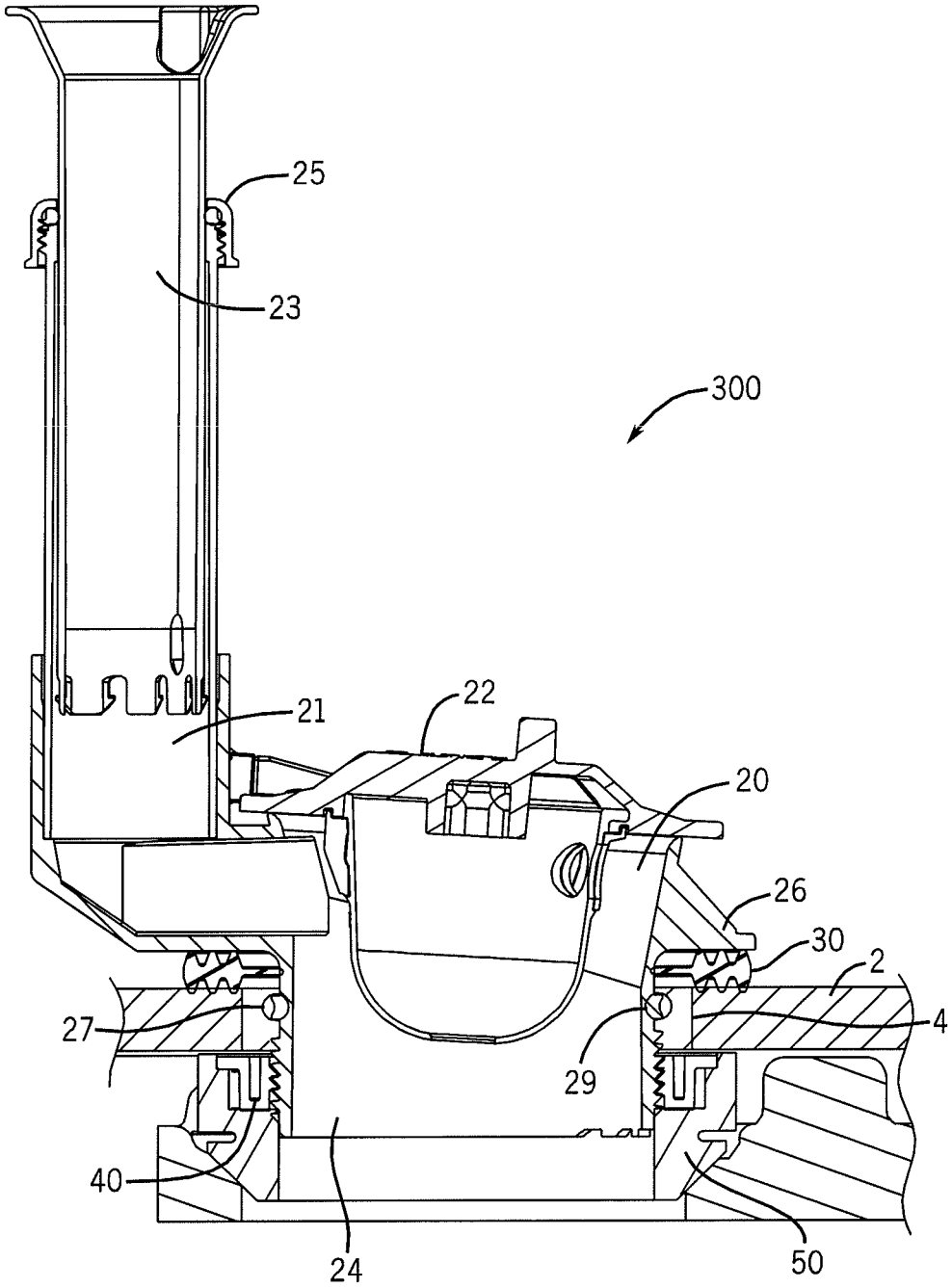
FIG. 3 is a side and cross-sectioned view of a third embodiment of the flush valve and assembly that is constructed in accordance with the present invention.

Referring now to FIG. 3, it illustrates a third flush valve assembly, generally identified 300, which is constructed in accordance with the present invention. The flush valve assembly 300 comprises the flush valve 20 and flapper valve 22 as previously discussed wherein the flapper valve 22 is movable between an "open" position which empties the tank and a "closed" position (as shown) which allows the tank to refill. A portion of the bottom 2 of the tank is shown in FIG. 3, together with the circular tank opening 4. In this assembly 300, the tank opening is 3.70 inches in diameter. The lower threaded portion 24 of the flush valve 20 extends through the tank opening 4. A portion of the flush valve 20 forms the flange 26 such that, when the flush valve 20 is mounted within the opening 4, the flange 26 captures a tank seal 30 between the flange 26 and the upper surface of the tank bottom 2 as previously described. In this particular assembly 300, an O-ring 27 seats within a recess 29 formed within the flush valve 20. This O-ring 27 allows the flush valve 20 to be properly "centered" within the 3.70 inch opening 4. As with the prior embodiments, a threaded locking nut 40 is used to secure the lower threaded portion 24 of the flush valve 20 to the tank. Disposed below the flush valve 20 is the full sponge gasket 50, the lower portion 56 of the sponge gasket 50 seating itself within throat of the toilet bowl 6.

Figure 4:
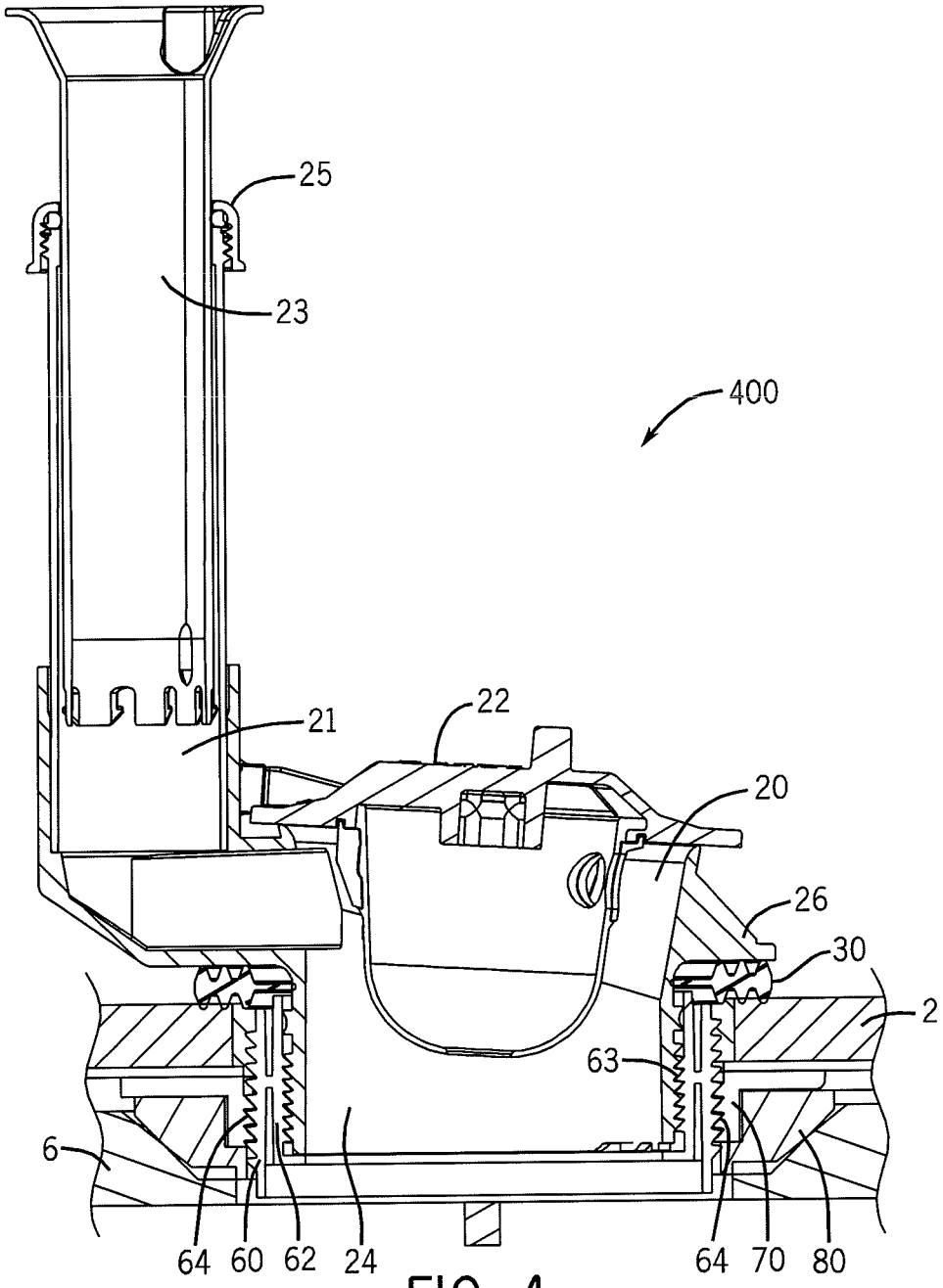
FIG. 4 is a side and cross-sectioned view of a fourth embodiment of the flush valve and assembly that is constructed in accordance with the present invention.

Referring now to FIG. 4, it illustrates a fourth flush valve assembly, generally identified 400, which is constructed in accordance with the present invention. The flush valve assembly 400 comprises the flush valve 20 and flapper valve 22 as previously described wherein the flapper valve 22 is movable between an "open" position which empties the tank and a "closed" position (as shown) which allows the tank to refill. A portion of the bottom 2 of the tank is shown in FIG. 4, together with the circular tank opening 4. In this assembly 400, the tank opening is 3.95 inches in diameter. The lower threaded portion 24 of the flush valve 20 extends through the tank opening 4. A portion of the flush valve 20 forms the flange 26 such that, when the flush valve 20 is mounted within the opening 4, the flange 26 captures a tank seal 30 between the flange 26 and the upper surface of the tank bottom 2 as previously described. In this particular assembly 400, however, a threaded adapter 60 is disposed between the threaded portion 24 of the flush valve 20 and the tank opening 4. The threaded adapter 60 comprises an inner portion 62 having a threaded surface 63 and an outer portion 64 having a threaded surface 65. In this assembly 400, the threaded portion 24 of the flush valve 20 can be threaded into the inner portion 62 of the adapter 60. A threaded nut 70 engages the outer threaded surface 65 of the adapter 60, disposing a gasket 80 between the nut 70 and the throat of the toilet bowl 6. It should be noted that the gasket 80 used in the assembly 400 of this embodiment is not the sponge gasket 50 discussed previously.

Although the foregoing has been described with a certain degree of particularity, it is to be understood that the present disclosure has been made by way of example only and that numerous changes in the construction and the arrangement of components, some of which have been alluded to, may be resorted to without departing from the spirit and scope of the invention as it is described.

The details of the invention having been disclosed in accordance with the foregoing, I claim:

1. A flush valve for use in a drain hole in the bottom wall of a toilet tank, the tank sitting above the throat of a toilet bowl, the flush valve comprising:

a flush valve body comprising a flange positioned above the bottom wall, a lower externally threaded portion that extends through the drain hole and a flapper valve;

an internally threaded lock nut, the lock nut configured to complement the lower threaded portion of the flush valve;

a tank seal disposed between the flange and the tank wall; and a tank to bowl sponge gasket disposed between the lower threaded portion of the flush valve, the lock nut and the tank wall and the throat of the toilet bowl, wherein the sponge gasket is a circular structure comprising:

an upper portion that is generally L-shaped in cross section and comprises a circumferential outer surface, a circumferential inner surface and a bottom shelf;

a lower portion comprising a circumferential inner surface and an inwardly tapered outer surface; and a circumferential trim line disposed below the outer surface of the upper portion and above the outer surface of the lower portion.

2. The flush valve of claim 1 wherein the trim line of the gasket allows the upper portion and the lower portion of the gasket to be separated from one another.

3. The flush valve of claim 2 wherein only the upper portion of the separated gasket portions is used with the flush valve.

4. The flush valve of claim 1 wherein the gasket is made of an elastomeric material.

5. The flush valve of claim 1 wherein the gasket is adapted for use in two piece 3 inch toilets ranging in diameter from 3.25 inches to 3.95 inches.

6. A flush valve assembly for use in a drain hole in the bottom wall of a toilet tank, the tank sitting above the throat of a toilet bowl, the assembly comprising:

a flush valve comprising a flange positioned above the bottom wall, a lower externally threaded portion that extends through the drain hole and a flapper valve;

an internally threaded lock nut, the lock nut configured to complement the lower threaded portion of the flush valve;

a tank seal disposed between the flange and the tank wall; and a tank to bowl sponge gasket disposed between the lower threaded portion of the flush valve, the lock nut and the tank wall and the throat of the toilet bowl, wherein the sponge gasket is a circular structure comprising:

an upper portion that is generally L-shaped in cross section and comprises a circumferential outer surface, a circumferential inner surface and a bottom shelf;

a lower portion comprising a circumferential inner surface and an inwardly tapered outer surface; and a circumferential trim line disposed below the outer surface of the upper portion and above the outer surface of the lower portion.

7. The assembly of claim 6 wherein the trim line of the gasket allows the upper portion and the lower portion of the gasket to be separated from one another.

8. The assembly of claim 7 wherein only the upper portion of the separated gasket portions is used with the assembly.

9. The assembly of claim 6 wherein the gasket is made of an elastomeric material.

10. The assembly of claim 6 wherein the gasket is adapted for use in two piece 3 inch toilets ranging in diameter from 3.25 inches to 3.95 inches.

11. A tank to bowl sponge gasket for use with a flush valve of the type that is used in a drain hole in the bottom wall of a toilet tank, the tank sitting above the throat of a toilet bowl, the flush valve further comprising a flange positioned above the bottom wall, a lower externally threaded portion that extends through the drain hole and a flapper valve; an internally threaded lock nut, the lock nut configured to complement the lower threaded portion of the flush valve; a tank seal disposed between the flange and the tank wall; and a tank to bowl sponge gasket disposed between the lower threaded portion of the flush valve, the lock nut and the tank wall and the throat of the toilet bowl, the gasket comprising:

an upper portion that is generally L-shaped in cross section and comprises a circumferential outer surface, a circumferential inner surface and a bottom shelf;

a lower portion comprising a circumferential inner surface and an inwardly tapered outer surface; and a circumferential trim line disposed below the outer surface of the upper portion and above the outer surface of the lower portion.

12. The gasket of claim 11 wherein the trim line of the gasket allows the upper portion and the lower portion of the gasket to be separated from one another.

13. The gasket of claim 12 wherein only the upper portion of the separated gasket portions is used.

14. The gasket of claim 11 wherein the gasket is made of an elastomeric material.

15. The gasket of claim 11 wherein the gasket is adapted for use in two piece 3 inch toilets ranging in diameter from 3.25 inches to 3.95 inches.

* * * * *